US010480359B2

(12) United States Patent
Bayrakdar

(10) Patent No.: US 10,480,359 B2
(45) Date of Patent: Nov. 19, 2019

(54) CAMSHAFT ADJUSTING DEVICE

(71) Applicant: Schaeffler Technologies AG & Co. KG, Herzogenaurach (DE)

(72) Inventor: Ali Bayrakdar, Rothenbach/Pegnitz (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 77 days.

(21) Appl. No.: 15/760,368

(22) PCT Filed: Aug. 11, 2016

(86) PCT No.: PCT/DE2016/200373

§ 371 (c)(1),
(2) Date: Mar. 15, 2018

(87) PCT Pub. No.: WO2017/071700

PCT Pub. Date: May 4, 2017

(65) Prior Publication Data

US 2018/0245487 A1 Aug. 30, 2018

(30) Foreign Application Priority Data

Oct. 28, 2015 (DE) ..... 10 2015 221 086
Aug. 5, 2016 (DE) ..... 10 2016 214 502

(51) Int. Cl.

| | |
|---|---|
| ***F01L 1/34*** | (2006.01) |
| ***F01L 1/344*** | (2006.01) |
| ***F01L 1/047*** | (2006.01) |
| ***F01L 1/352*** | (2006.01) |
| ***F01L 1/24*** | (2006.01) |

(52) U.S. Cl.

CPC ..... *F01L 1/3442* (2013.01); *F01L 1/047* (2013.01); *F01L 1/24* (2013.01); *F01L 1/344* (2013.01); *F01L 1/352* (2013.01); *F01L 2001/0473* (2013.01); *F01L 2001/2444* (2013.01); *F01L 2001/34433* (2013.01)

(58) Field of Classification Search

CPC . F01L 1/24; F01L 1/344; F01L 1/3442; F01L 2001/2444; F01L 2001/34433

USPC ..... 123/90.15, 90.17

See application file for complete search history.

(56) References Cited

U.S. PATENT DOCUMENTS

| | | | | |
|---|---|---|---|---|
| 8,251,029 | B2 * | 8/2012 | Kurisu | F01L 1/352 123/90.15 |
| 2010/0180845 | A1 | 7/2010 | Kurisu et al. | |
| 2011/0132303 | A1 | 6/2011 | Puetz et al. | |
| 2013/0228142 | A1 | 9/2013 | Kobayashi et al. | |

FOREIGN PATENT DOCUMENTS

| | | |
|---|---|---|
| DE | 102008036182 | 2/2010 |
| DE | 10201000047 | 7/2010 |
| DE | 102013003556 | 9/2013 |
| EP | 1571301 | 9/2005 |
| EP | 1696107 | 8/2006 |

* cited by examiner

*Primary Examiner* — Ching Chang
(74) *Attorney, Agent, or Firm* — Volpe and Koenig, P.C.

(57) ABSTRACT

A camshaft adjusting device (1) is provided having a camshaft adjuster (2, 3) and a camshaft (4) characterized in that the camshaft (4) include a camshaft end (5) which is designed to receive a first hydraulically actuatable camshaft adjuster (2) as well to receive a second hydraulically actuatable camshaft adjuster (3).

10 Claims, 2 Drawing Sheets

CAMSHAFT ADJUSTING DEVICE

FIELD OF THE INVENTION

The invention relates to a camshaft adjusting device.

BACKGROUND OF THE INVENTION

Camshaft adjusters are used in internal combustion engines to vary the control times of the combustion chamber valves, in order to variably shape the phase relation between a crankshaft and a camshaft in a defined angle range between a maximum advanced position and a maximum retarded position. Adapting the control times to the current load and rotational speed reduces the fuel consumption and emissions. For this purpose, camshaft adjusters are integrated into a drivetrain by which torque is transferred from the crankshaft to the camshaft. This drivetrain can be constructed, for example, as a belt, chain, or gearwheel drive.

In a hydraulic camshaft adjuster, the driven element and the drive element form one or more pairs of mutually interacting pressure chambers that can be loaded with hydraulic medium. The drive element and the driven element are in a coaxial arrangement. By filling and emptying individual pressure chambers, a relative movement between the drive element and the driven element is generated. A spring arranged to provide a rotating effect between the drive element and the driven element forces the drive element relative to the driven element in a preferred direction. This preferred direction can be in the same or opposite direction as the rotation.

One construction of the hydraulic camshaft adjuster is the vane-cell adjuster. The vane-cell adjuster has a stator, a rotor, and a drive wheel with external teeth. The rotor is constructed as a driven element usually so that it can be connected locked in rotation with the camshaft. The drive element includes the stator and the drive wheel. The stator and the drive wheel are connected locked in rotation with each other or are alternatively constructed integrally with each other. The rotor is arranged coaxial to the stator and inside of the stator. The rotor and the stator form mutually interacting oil chambers with their radially extending vanes and these chambers can be charged by oil pressure and allow a relative rotation between the stator and the rotor. The vanes are constructed either integrally with the rotor or the stator or are arranged as "nested vanes" in grooves provided for this reason in the rotor or the stator. The vane-cell adjusters also have various sealing covers. The stator and the sealing covers are secured with each other by threaded connections.

Another construction of the hydraulic camshaft adjuster is the axial piston adjuster. Here, a displacement element is moved axially by oil pressure, which generates a relative rotation between a drive element and a driven element using helical gearing.

Another construction of a camshaft adjuster is the electromechanical camshaft adjuster that has triple-shaft gearing (for example, planetary gearing). Here, one of the shafts forms the drive element and a second shaft forms the driven element. By means of the third shaft, rotational energy can be fed to the system or discharged from the system by a control device, for example, an electric motor or a brake. A spring can also be arranged, which supports or restores the relative rotation between the drive element and the driven element.

EP 1 571 301 A1 shows a camshaft adjusting arrangement, wherein different power sources for adjustments are provided for two camshafts.

DE 10 2010 000 047 A1 shows a valve control device with a drive rotor that turns with a crankshaft, a driven rotor that turns with a camshaft, a planet gear that performs a planetary motion for adjusting the rotational phase between the camshaft and the crankshaft, a motor shaft that turns for controlling the planetary motion, a cylindrical planet gear carrier that carries the planet gear and is connected to the motor shaft such that the planet gear performs a planetary motion, and a lubricating device. The lubricating device has a feed opening that opens on a side surface of the second rotor axially opposite the planet gear carrier. The feed opening extends past an outer bearing surface and an inner connection surface. Lubricant is led by the feed opening into the first rotor.

DE 10 2013 003 556 A1 shows a variable valve time control device. This has a drive-side rotating component, a driven-side rotating component that is positioned coaxial with a rotational axis of the drive-side rotating component, at least one plate, a plurality of partition areas that form a fluid chamber between the partition areas, a pusher area that is adapted by it within a movement area in the fluid chamber for the relative rotation of the drive-side rotating component and the driven-side rotating component, a limiting mechanism for limiting a relative rotational phase, a fastening component that fastens the plate and the partition area of the drive-side rotating component, and a reinforcement component that engages with the partition area that has a contact surface in the partition areas, wherein the contact surface is formed for receiving a contact of the pusher area when the relative rotational phase is either a mostly retarded angle phase or a mostly advanced angle phase.

SUMMARY

The object of the invention is to provide a camshaft adjusting device that enables especially simple assembly of the camshaft adjuster with a camshaft.

Thus, the objective is achieved according to the invention by a camshaft adjusting device with a camshaft adjuster and a camshaft, such that the camshaft has a camshaft end that is provided or constructed both for receiving a first hydraulically actuatable camshaft adjuster and also for receiving a second hydraulically actuatable camshaft adjuster.

In this way it is achieved that an integrally formed camshaft end or an integrally formed connection location for a camshaft adjuster is suitable both for a first hydraulic camshaft adjuster and also for a second hydraulic camshaft adjuster and an incorrect assembly of a camshaft adjuster on a camshaft not provided for this is avoided.

For a first hydraulic camshaft adjuster, for operating a central magnet for a central valve and for a second hydraulic camshaft adjuster, a decentralized control valve is provided. An incorrect assembly of a camshaft adjuster on an incorrect camshaft end would also have the effect that an incorrect oil interface would then be opposite the incorrectly installed camshaft adjuster. The result is complicated disassembly. This result is avoided according to the invention. A construction according to the invention also advantageously provides that the connection location for two hydraulic camshaft adjusters preferably controlled in different ways has the same construction.

According to the invention, the camshaft end has two different threads for receiving a screw. Thus, it is advantageously not critical whether a simple central screw without a valve function is used as the fastener for fastening a second hydraulic camshaft adjuster or a central valve screw/central screw is used for fastening a first hydraulic camshaft adjuster. A thread is provided for the respective use case. If a camshaft adjuster provided for the corresponding intake or exhaust camshaft is mounted accordingly, then the corresponding unused thread remains non-functional.

In one advantageous construction, the camshaft end has an oil conduit that is constructed for the first hydraulically actuatable camshaft adjuster. Advantageously, the oil conduit is formed by the fastener, e.g., a central screw or a central valve screw, and a wall of the camshaft. Alternatively, holes can be provided in the camshaft and/or in the fastener for the axial guidance of the oil.

In another advantageous construction, the camshaft end has an oil conduit that is constructed for the second hydraulically actuatable camshaft adjuster. Advantageously, the oil conduit is constructed by the fastener, e.g., a central screw, and a wall of the camshaft. Alternatively, holes can be provided in the camshaft and/or in the fastener for the axial guidance of the oil.

The arrangement according to the invention achieves flexibility for the assembly of a camshaft adjuster with a certain function on one or more camshafts.

BRIEF DESCRIPTION OF THE DRAWINGS

Embodiments of the invention are shown in the figures. Shown are.

DETAILED DESCRIPTION

Figure 1:
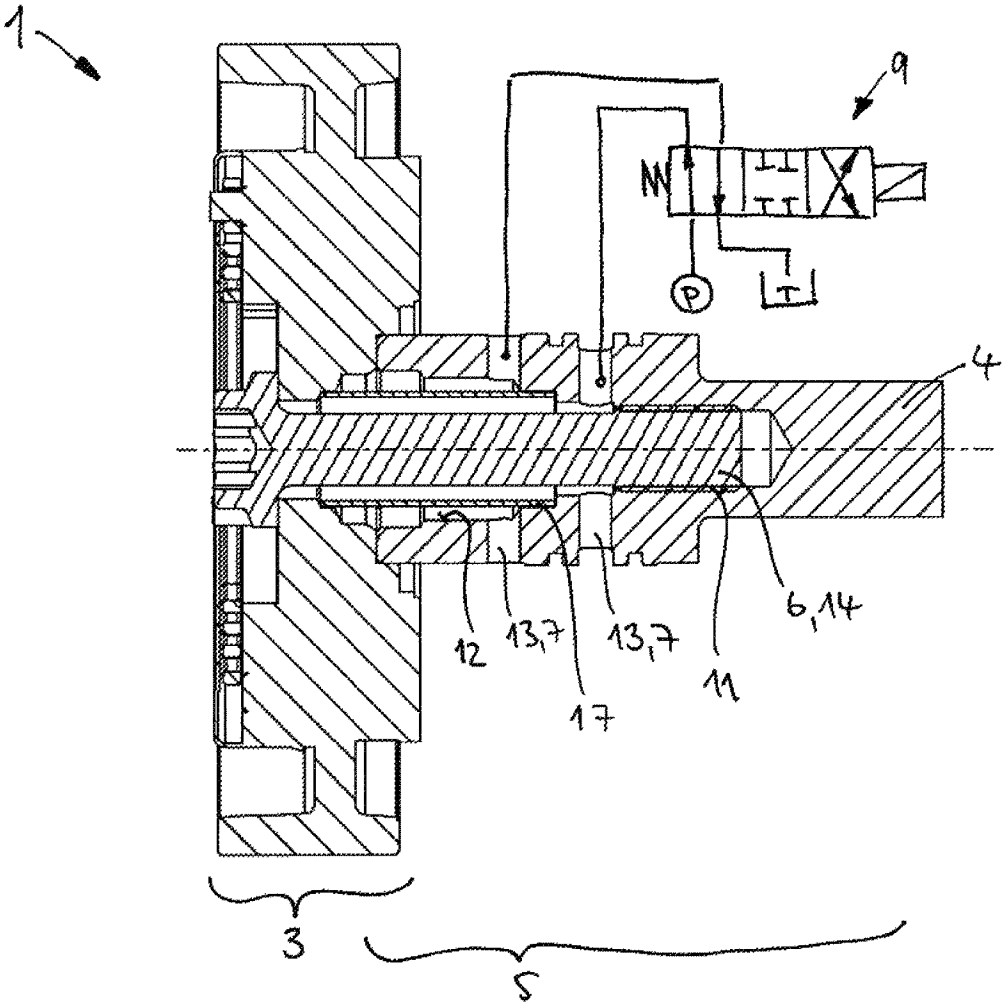
FIG. 1 a camshaft adjusting device with an electromechanical camshaft adjuster and with an integrally formed camshaft, and FIG. 2 a camshaft adjusting device with a hydraulic camshaft adjuster and with the integrally formed camshaft according to FIG. 1.

FIG. 1 shows a camshaft adjusting device 1 with a hydraulic camshaft adjuster 3 and with an integrally formed camshaft end 5.

Figure 2:
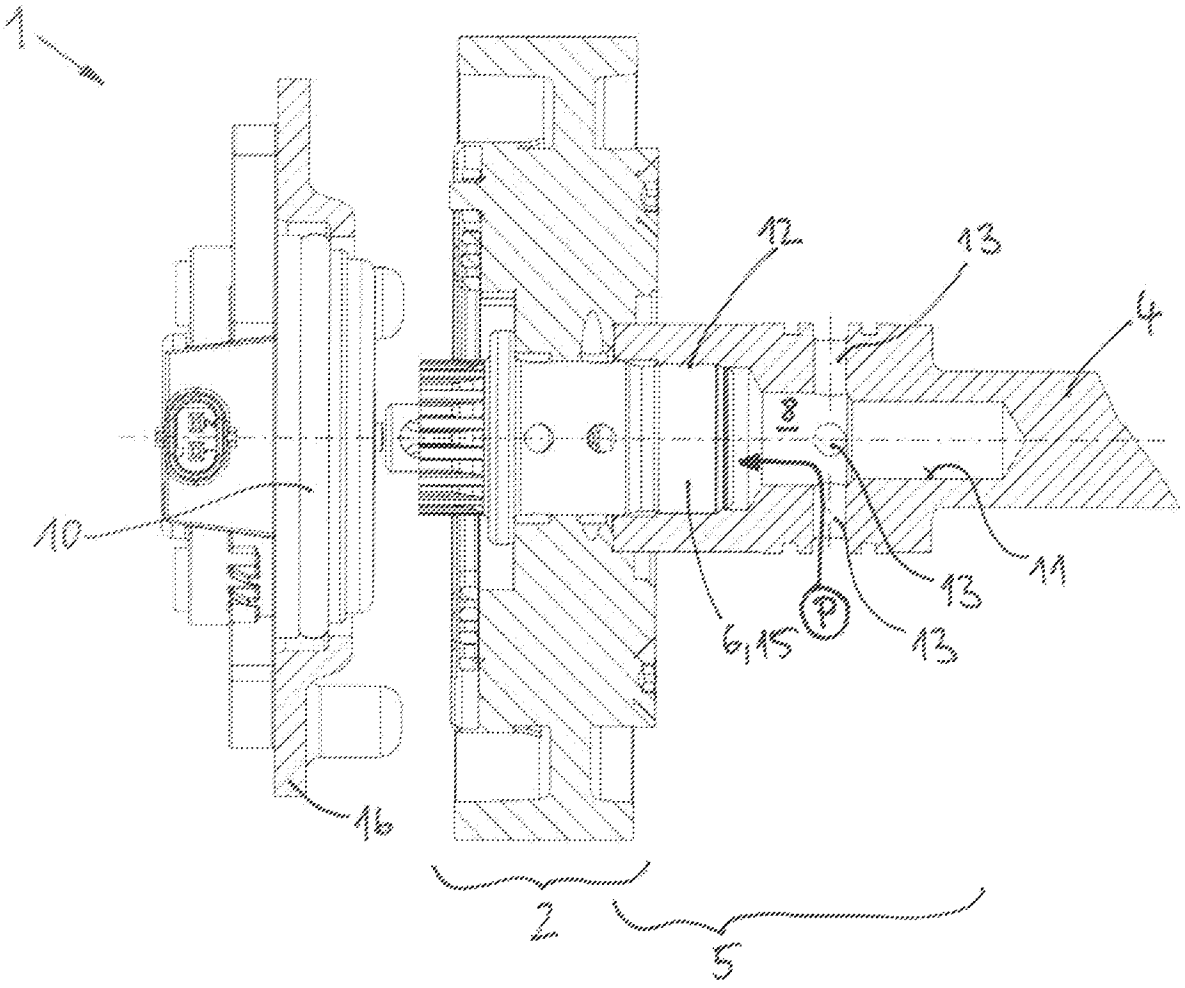

FIG. 2 shows a camshaft adjusting device 1 with another hydraulic camshaft adjuster 2 and with the integrally formed camshaft end 5 according to FIG. 1.

The difference between the camshaft adjusting device 1 in FIG. 1 and in FIG. 2 is that a first hydraulic or a second hydraulic camshaft adjuster 2, 3 is fastened to the camshaft end 5 of the camshaft 4. The camshaft end 4 is formed identically according to the invention in both embodiments and has two threads 11, 12 that are different from each other and in which the fastener formed as screw 6 engages. The screw 6 is formed for the second hydraulic camshaft adjuster 3 as a simple central screw 14. For the first hydraulic camshaft adjuster 2, the screw 6 is provided with a valve function—that is, a central valve screw 15. The central valve screw 15 and the central screw 14 engage in the respective thread 11, 12 provided for the respective screw formation. The central screw 14 for the second hydraulic camshaft adjuster 3 forms with the wall of the sleeve 17 an oil conduit 7 in the form of a gap through which one of the working chambers of the second hydraulic camshaft adjuster 3 can be pressurized. The radial hole 13 with which the oil is fed into the camshaft 4 is arranged in the axial direction along the rotational axis of the camshaft adjusting device 1 between the thread 11 and the camshaft adjuster 3. Due to the uniformity of the camshaft end 5, the oil conduit 7 is also formed by the thread 12 suitable for the central valve screw 15 and the sleeve 17, whereby the other working chamber of the second hydraulic camshaft adjuster 3 can be pressurized.

In contrast to FIG. 1, the camshaft adjusting arrangement 1 according to FIG. 2 is fastened with the hydraulic camshaft adjuster 2 by a screw 6 formed as a central valve screw 15 on the camshaft end 5. The oil is led to the oil conduit 8 back from the radial hole 13 into the interior of the camshaft end 5 with the difference that due to the lack of the screw 6 suitable for the electromechanical camshaft adjuster 3, the receptacle volume is significantly larger, and the oil flow is fed to the central valve screw 15 in the axial direction. The thread 11 is still part of the boundary of the oil conduit 8, but is non-functional with respect to fastening.

In FIG. 1, for actuating the camshaft adjusting device 1 there is a control valve 9 in a decentralized arrangement, for example, as a 4/3 directional control valve. The pressure agent source P delivers the oil pressure necessary for operation. The reservoir T collects the out-flowing oil. A movable control piston of the control valve 9 is moved with an electromagnet into the different connection configurations. The sleeve 17 separates two oil supplies for operating the second hydraulic camshaft adjuster 3.

In FIG. 2, for actuating the camshaft adjusting device 1, a central magnet 10 is arranged axially adjacent to the hydraulic camshaft adjuster 2. The central magnet 10 is held by a housing part 16.

LIST OF REFERENCE SYMBOLS

1) Camshaft adjusting device
2) First camshaft adjuster (hydraulic)
3) Second camshaft adjuster (hydraulic)
4) Camshaft
5) Camshaft end
6) Screw
7) Oil conduit
8) Oil conduit
9) Control valve
10) Central magnet
11) Thread
12) Thread
13) Radial hole
14) Central screw
15) Central valve screw
16) Housing part
17) Sleeve

The invention claimed is:

1. A camshaft adjusting device, comprising a camshaft adjuster and a camshaft, the camshaft includes a camshaft end constructed both for receiving a first hydraulically actuatable camshaft adjuster with a first connection and for receiving a second hydraulically actuatable camshaft adjuster with a second connection that is different than the first connection, and the camshaft end has two different threads, each configured to receive a respective screw for the first connection or the second connection.

2. The camshaft adjusting device according to claim 1, wherein the camshaft end has a first oil conduit that is constructed for the first hydraulically actuatable camshaft adjuster.

3. The camshaft adjusting device according to claim 2, wherein the camshaft end has a second oil conduit that is constructed for the second hydraulically actuatable camshaft adjuster.

4. A camshaft adjusting device, comprising:

a camshaft having a camshaft end constructed both for receiving a first hydraulically actuatable camshaft adjuster with a first connection and for receiving a second hydraulically actuatable camshaft adjuster with a second connection that is different than the first connection, and the camshaft end has two different threads, each configured to receive a respective screw for the first connection or the second connection.

5. The camshaft adjusting device of claim 4, further comprising a first hydraulically actuatable camshaft adjuster with the first connection, and a first screw that engages in a first of the two different threads.

6. The camshaft adjusting device of claim 5, wherein the first screw comprises a central valve screw.

7. The camshaft adjusting device of claim 5, wherein the first screw is adapted to block an oil conduit in the camshaft end that is configured for feeding the second hydraulically actuatable camshaft assembly.

8. The camshaft adjusting device of claim 4, further comprising a second hydraulically actuatable camshaft adjuster with the second connection, and a second screw that engages in a second of the two different threads.

9. The camshaft adjusting device of claim 8, further comprising a sleeve that surrounds a portion of the second screw and separates two oil supplies adapted to be supplied from the camshaft end for operating the second hydraulically actuatable camshaft adjuster.

10. The camshaft adjusting device of claim 9, further comprising a control valve that is configured to feed oil to the two oil supplies in order to actuate the second hydraulically actuatable camshaft adjuster.

* * * * *